US006957982B1

(12) United States Patent
Hyland et al.

(10) Patent No.: US 6,957,982 B1
(45) Date of Patent: Oct. 25, 2005

(54) STACKED MODULAR JACK

(75) Inventors: James H. Hyland, Hummelstown, PA (US); Iosif R. Korsunsky, Harrisburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/913,042

(22) Filed: Aug. 5, 2004

(51) Int. Cl.[7] ..... H01R 13/66
(52) U.S. Cl. ..... 439/620; 439/607; 439/490
(58) Field of Search ..... 439/607, 620, 439/676, 490

(56) References Cited

U.S. PATENT DOCUMENTS 4,789,847 A * 12/1988 Sakamoto et al. ..... 333/185
5,344,342 A * 9/1994 Briones ..... 439/620
6,102,741 A * 8/2000 Boutros et al. ..... 439/620
6,227,911 B1 * 5/2001 Boutros et al. ..... 439/620
6,328,595 B1 * 12/2001 Chang ..... 439/490
6,334,787 B1 * 1/2002 Chang ..... 439/490
6,497,588 B1 * 12/2002 Scharf et al. ..... 439/607
6,537,110 B1 * 3/2003 Korsunsky et al. ..... 439/676
6,663,437 B2 12/2003 Korsunsky et al.
6,739,912 B2 * 5/2004 Korsunsky et al. ..... 439/620
6,773,302 B2 * 8/2004 Gutierrez et al. ..... 439/541.5
2002/0146940 A1 * 10/2002 Colantuono et al. ..... 439/676
2003/0211782 A1 * 11/2003 Esparaz et al. ..... 439/620

* cited by examiner

*Primary Examiner*—Ross Gushi
*Assistant Examiner*—Larisa Tsukerman
(74) *Attorney, Agent, or Firm*—Wei Te Chung

(57) ABSTRACT

A stacked modular jack (100) mounted on a mother printed circuit board includes an insulative casing (3), a magnetic subassembly (2) disposed within the casing and an outer shield (1) enclosing the casing. The magnetic subassembly includes a single molded housing (21) having a receptacle (212) forwardly extending from a main body (211) thereof. A plurality of barriers (218) are formed in a bottom surface of the receptacle for retaining magnetic coils and transformers. The magnetic subassembly further includes an optional magnetic box liner (25) defining a plurality of channels (255) for cooperating with corresponding barriers of the housing for shielding the coils and transformers from other inside components of the modular jack, thereby effectively reducing electromagnetic interference.

9 Claims, 9 Drawing Sheets

STACKED MODULAR JACK

BACKGROUND OF THE INVENTION

1. Field of the Invention

This invention generally relates to a stacked modular jack and more particularly, to a stacked local area network (LAN) for high speed signal transmission.

2. Description of the Prior Art

It is quite common to use modular jacks for the data transmission in high speed applications such as IEEE 802.3 10 Base-T or 100 Base-T local area networks. A common problem to these high speed modular jacks is their tendency to emit high frequency radiation. There is also a need to provide means for suppressing undesirable noise. As a result, more electrical components are assembled in a modular jack to eliminate electromagnetic interference. U.S. Pat. No. 6,663,437 issued to Korsunsky et al discloses a modular jack including an insulative casing and an electrical subassembly disposed within the housing. The electrical subassembly includes a first and a second contact array assemblies each having a printed circuit board. A first and second magnetic module respectively connects with corresponding contact array assemblies. A third printed circuit board disposed above the first printed circuit board includes a plurality of signal conditioning components thereon. A number of pins connect with the first, second and third printed circuit board. However, the three printed circuit boards are very closed to each other, accordingly electronic components may still suffer from electromagnetic interference which may not be acceptable for high-end signal communication. Furthermore, the assembly steps become relative complicated.

Hence, an improved modular jack is desired to overcome the above problems.

BRIEF SUMMARY OF THE INVENTION

It is an object of the present invention to provide a stacked modular jack which has a simple structure and can effectively reduce electromagnetic interference.

In order to attain the objective above, a stacked modular jack mounted on a mother printed circuit board includes an insulative casing, a magnetic subassembly disposed within the casing and an outer shield enclosing the casing. The magnetic subassembly includes a single molded housing having a receptacle forwardly extending from a main body thereof. A plurality of barriers are formed in a bottom surface of the receptacle for receiving magnetic coils and transformers. The magnetic subassembly further includes an optional magnetic box liner defining a plurality of channels for cooperating with corresponding barriers of the housing for shielding the coils and transformers from other inside components of the modular jack, thereby effectively reducing electromagnetic interference.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which corresponding reference numerals identify like elements in the figures and in which:

DETAILED DESCRIPTION OF THE INVENTION

Reference will now be made in detail to the preferred embodiment of the present invention.

Figure 1:
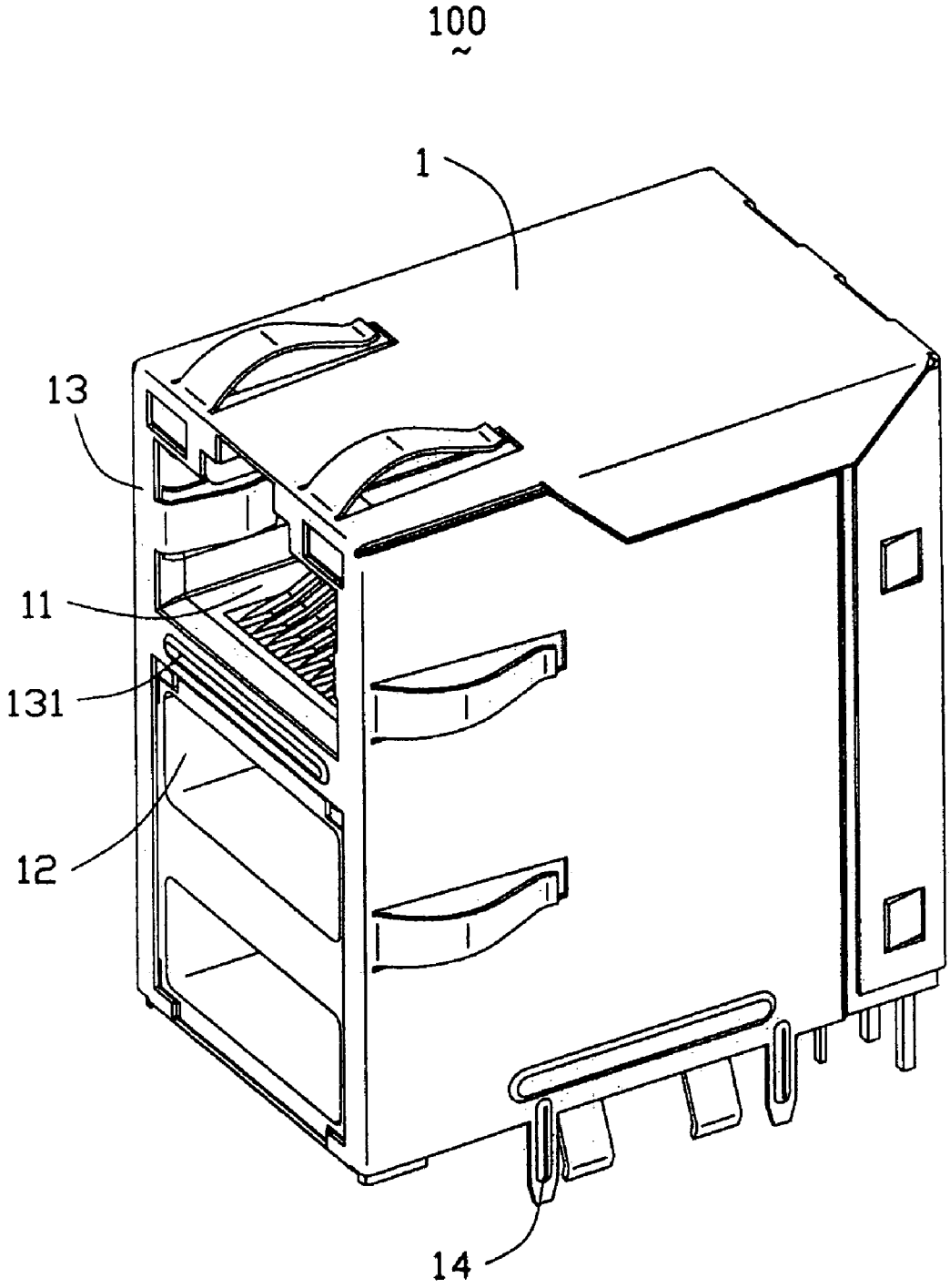
FIG. 1 is a perspective view of a stacked modular jack according to the present invention.
Figure 2:
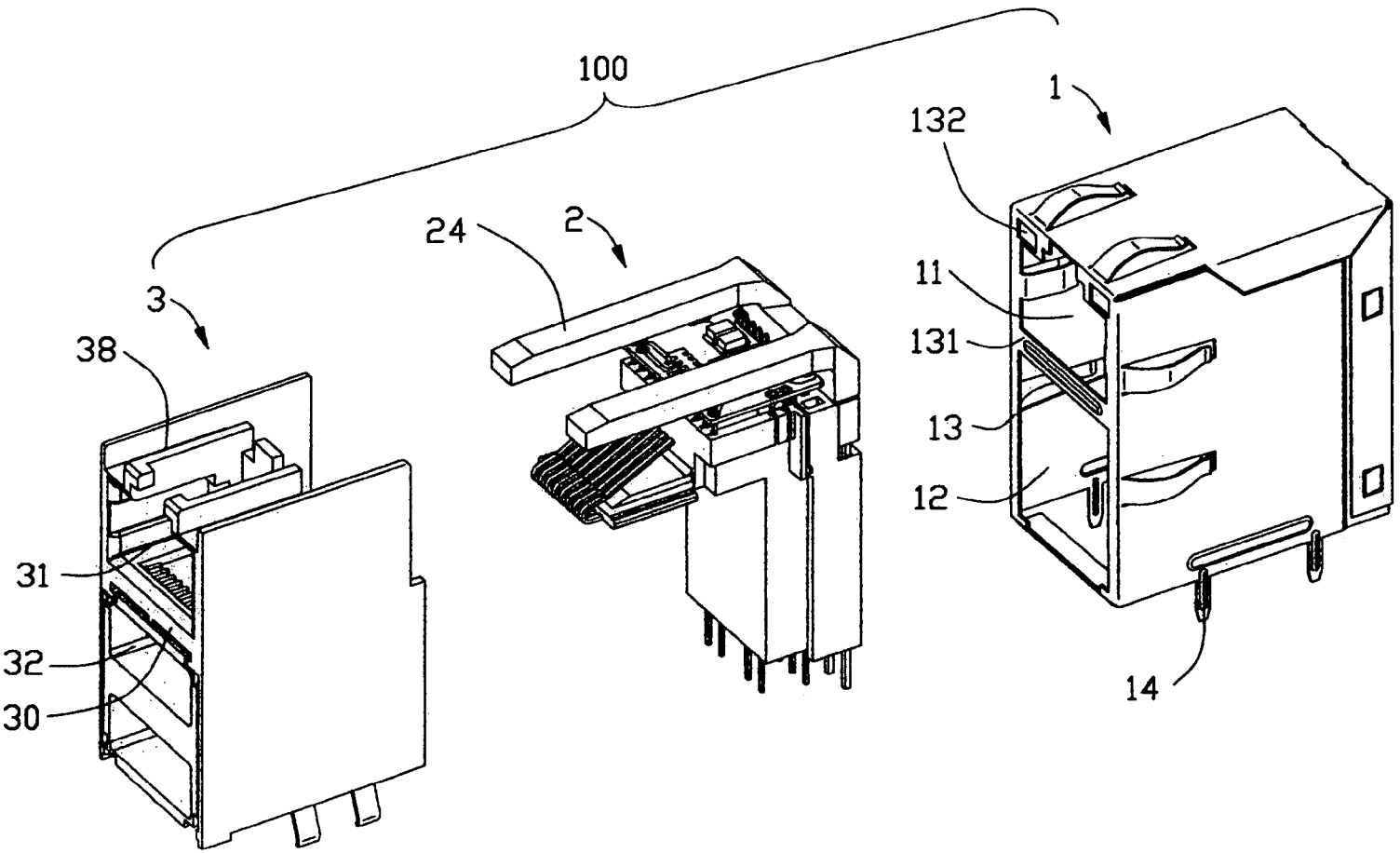
FIG. 2 is an exploded view of FIG. 1.
Figure 3:
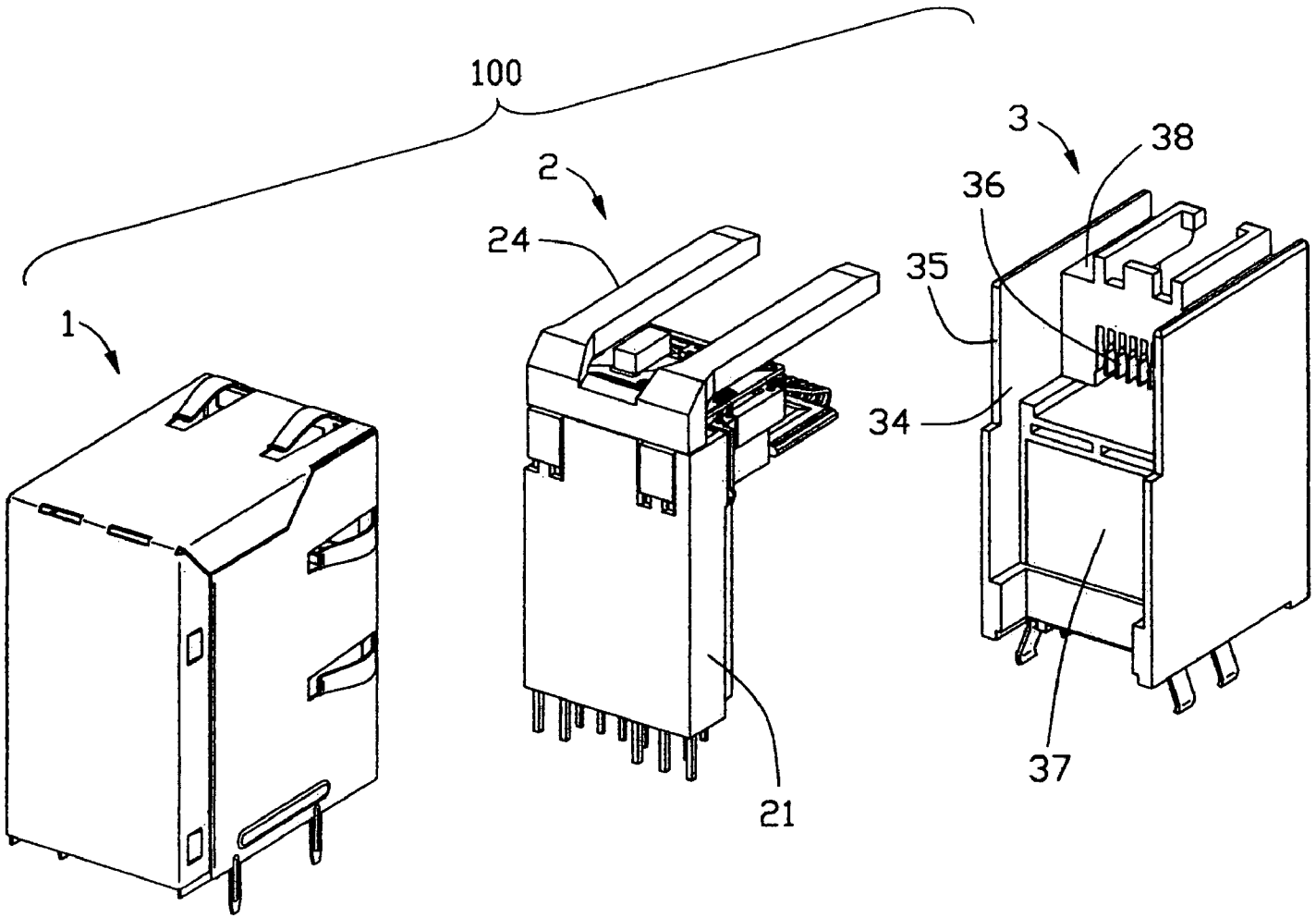
FIG. 3 is a similar view to FIG. 2 but taken from another perspective.
Figure 4:
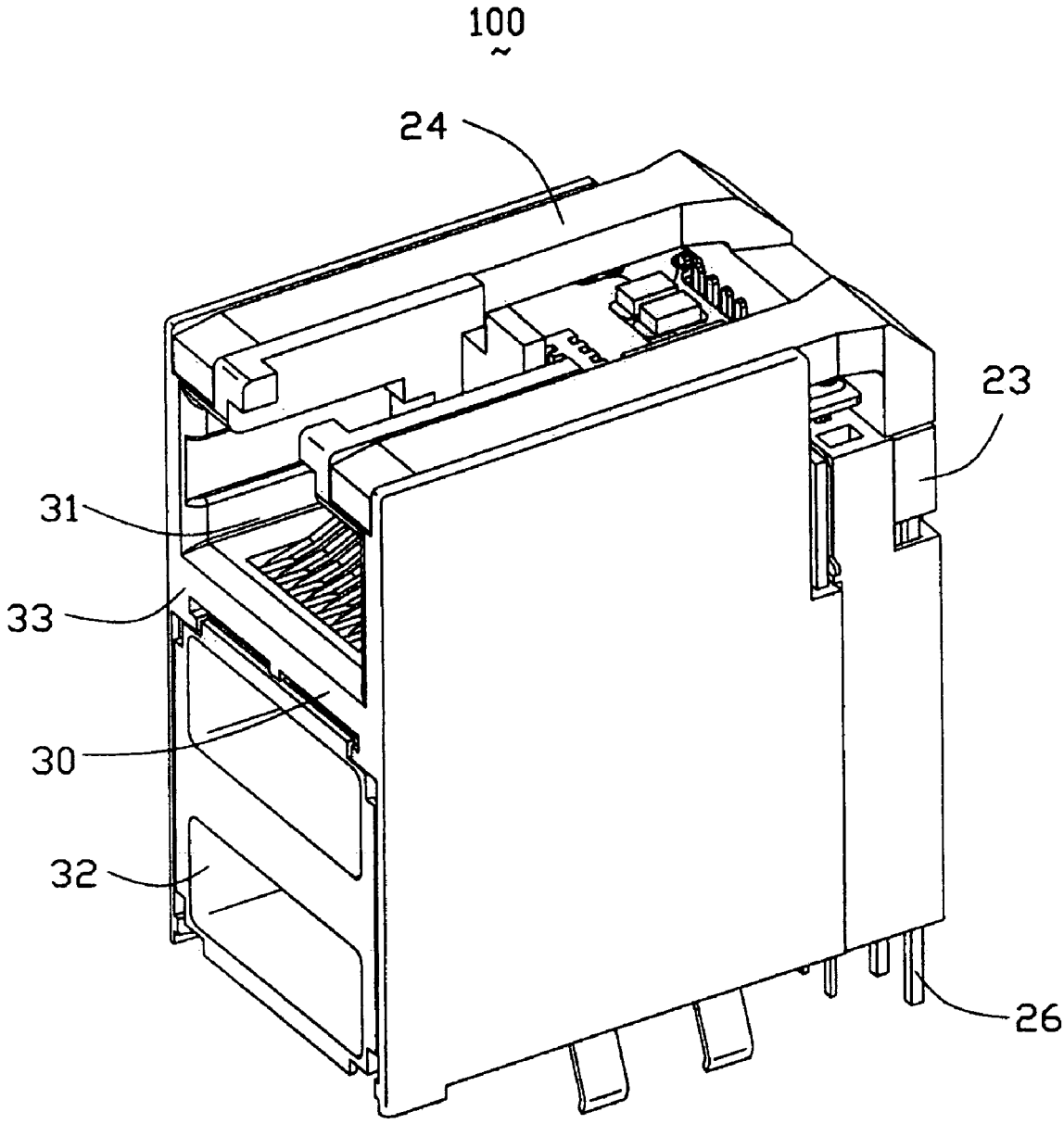
FIG. 4 is a partially assembled view of the stacked modular jack.
Figure 5:
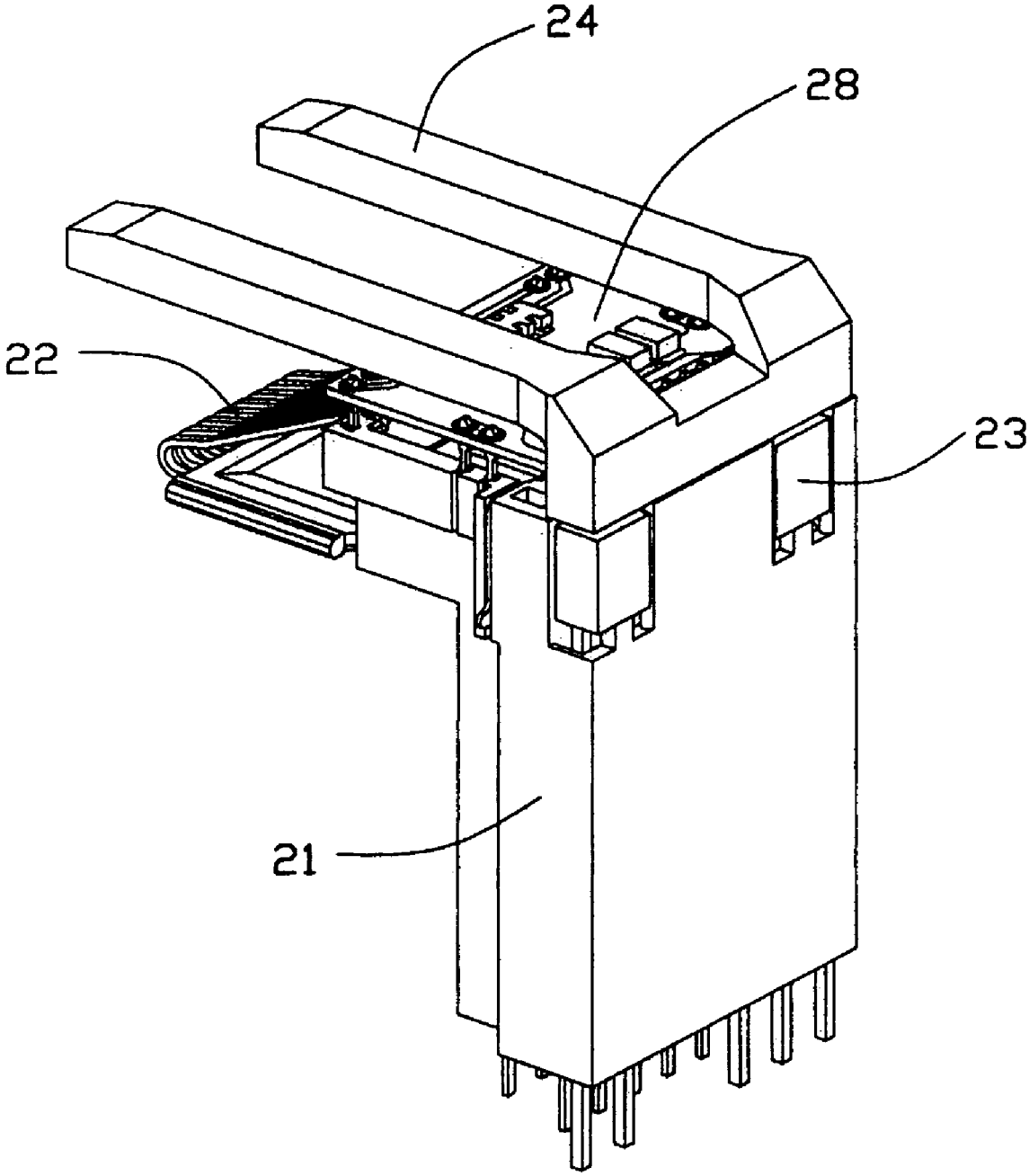
FIG. 5 is an perspective view of a magnetic subassembly of the stacked modular jack.
Figure 6:
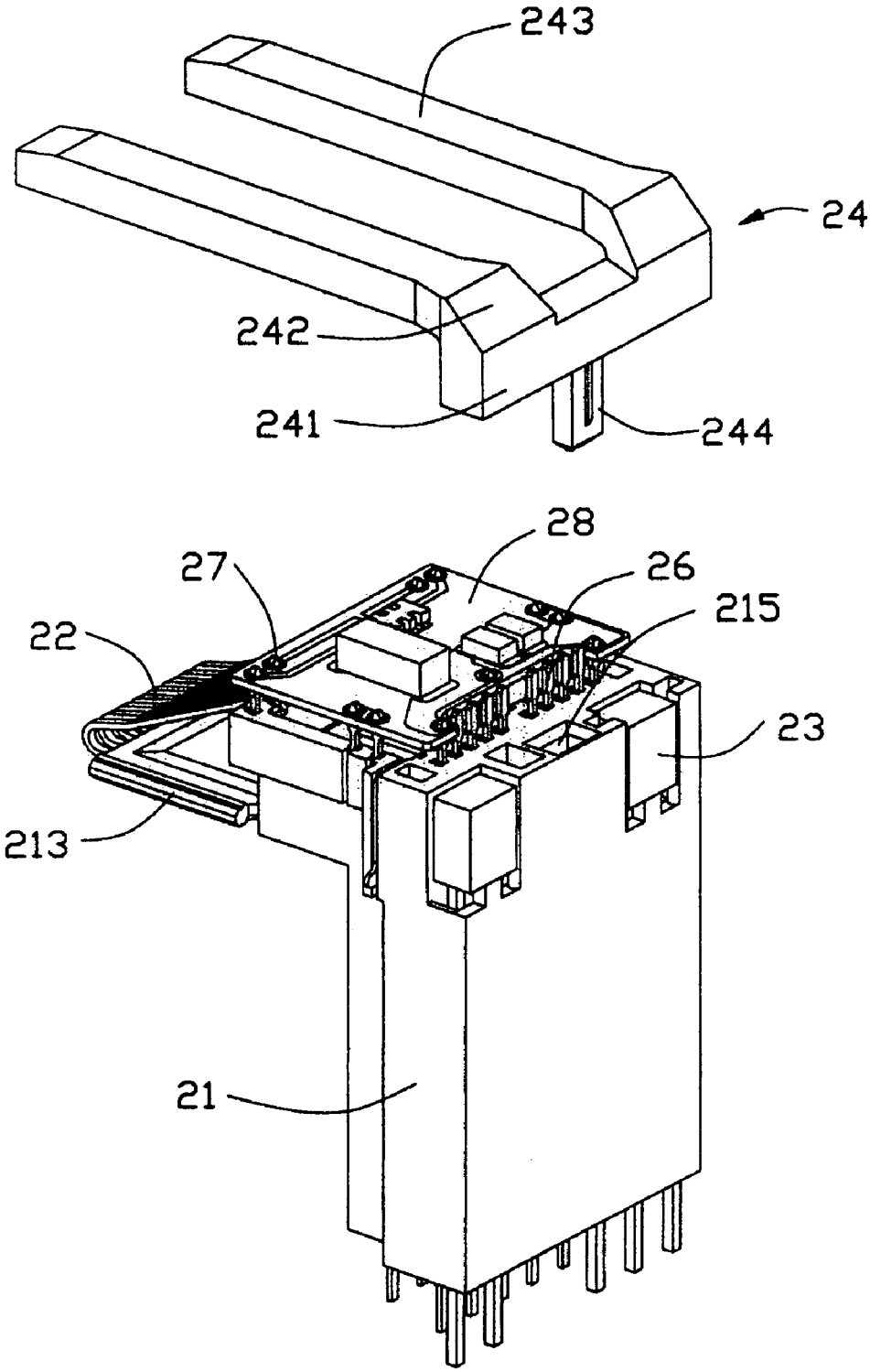
FIG. 6 is a partially exploded view of the magnetic subassembly.

Stacked modular jack 100 according to the present invention is seen in FIGS. 1–3 and includes an insulative casing 3, an magnetic subassembly 2 disposed within the insulative casing 3 and an outer metal shield 1 optionally enclosing the insulative casing 3 for electromagnetic interference (EMI) protection.

Referring to FIGS. 5–9, the magnetic subassembly 2 comprises a single molded housing 21, a plurality of contacts 22, a pair of light emitting diodes (LED) 23, a light pipe 24, a magnetic box liner 25 disposed within the housing 21, a first pin array 26 and a second pin array 27 fixed in the housing 21, a daughter printed circuit board 28 disposed above the single molded housing 21 and a plurality of coils 29 retained in the single molded housing 21.

Figure 7:
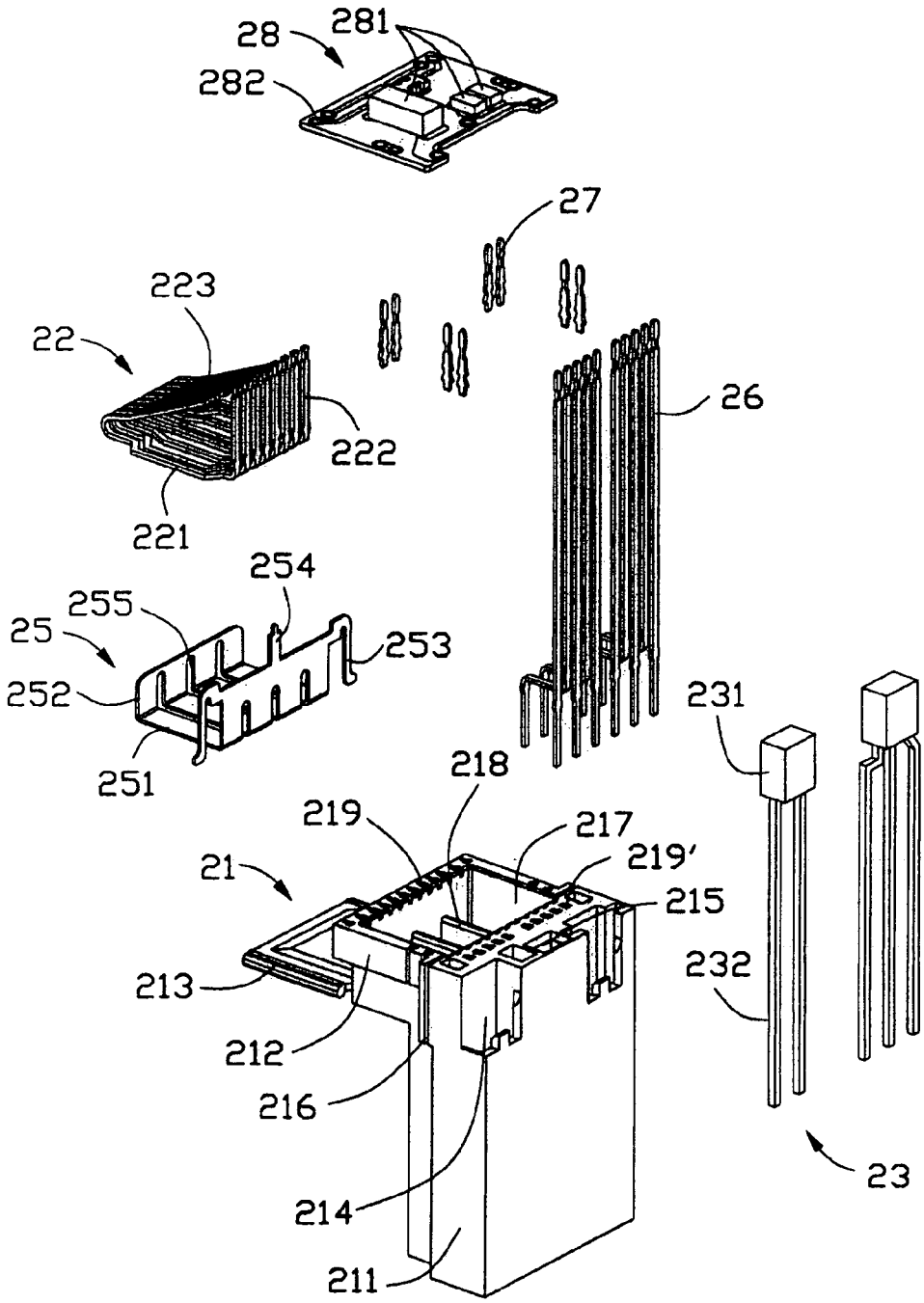
FIG. 7 is an exploded view of the magnetic subassembly, with a light pipe removed away.
Figure 8:
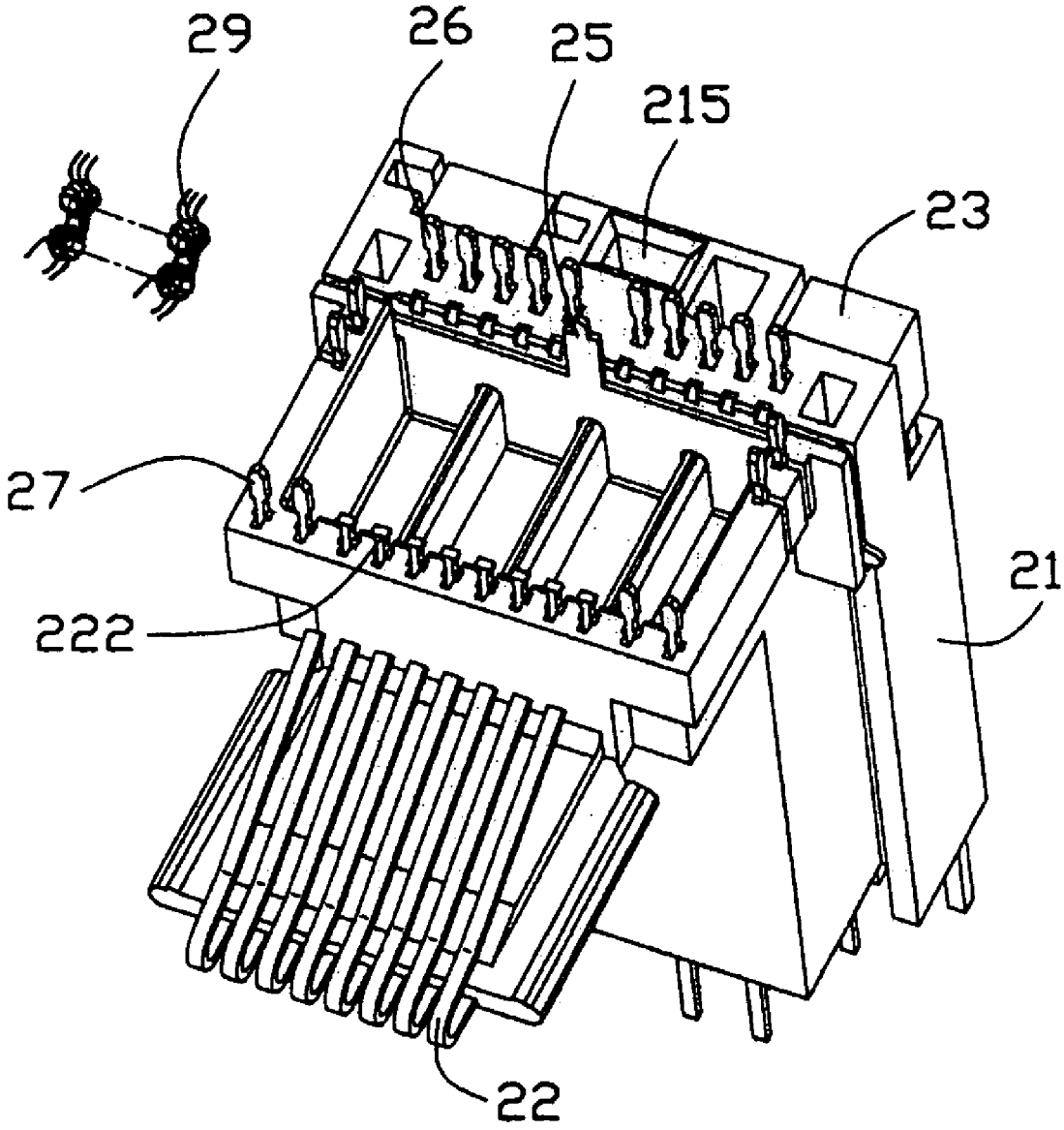
FIG. 8 is a partially perspective view of the magnetic subassembly from a top perspective, with an internal printed circuit board removed away.

Referring to FIG. 7, the single molded housing 21 is substantially L-shaped and includes an upright main body 211, a substantially cubic receptacle 212 forwardly and horizontally extending from a top portion of the main body 211 and a horizontal flat 213 positioned in a front portion of the receptacle 212 for fixing the contacts 22. The main body 211 includes a pair of receiving cavities 214 through a top wall thereof for receiving the LEDs 23 respectively positioned opposed sides of a rear wall thereof. A notch 215 is defined in a substantially middle portion of the top wall of the main body 211. A pair of slots 216 are defined in opposite sides of a front wall of the main body 211.

The receptacle 212 defines a receiving room 217 through a top wall thereof. A plurality of barriers 218 are formed on a bottom wall of the receptacle 212 and upwardly project into the receiving room 217. A plurality of recesses 219 are defined in the top wall of the receptacle 212 for receiving the second pin array 27 and the contacts 22. A plurality of apertures 219' are defined in the top wall and through a bottom wall of the main body 211 for receiving the first pin array 26.

Each contact 22 includes a horizontal fixing portion 221 insert molded or assembled to the flat 213 of the housing 21, a vertical connecting portion 222 upwardly extending from the fixing portion 221 and inserted into the recesses 219 of the single molded housing 21, a contacting portion 223 slantways projecting from a front portion of the fixing portion 221 for contacting with a mating connector (not shown).

The LEDs 23 are inserted into the receiving cavity 214 of the housing 21 and each includes a light portion 231 for functioning as a visual indicator and a pair of legs 232 downwardly extending from the light portion 231. The legs 232 downwardly project beyond the bottom wall of the housing 21 to electrically connecting with the printed circuit board.

The light pipe 24 includes a light-entry zone 241, a pair of light reflection zones 242 positioned on a top portion of the light-entry zone 241, a pair of light indicator zones 243 transversely extending from corresponding light reflection zones 242 and a post 244 downwardly extending from a middle portion of the light-entry 241 and inserted into the notch 215 of the housing 21. Therefore, the light pipe 24 is secured to the single molded housing 21 with the light-entry zone 241 abutting against the light portions 231 of the LEDs 23. In use, the light pipe 24 receives light signals from the LEDs 231 and reflects same forward to the light indicator zones 243 which are visible at the front of the stacked modular jack 100.

Figure 9:
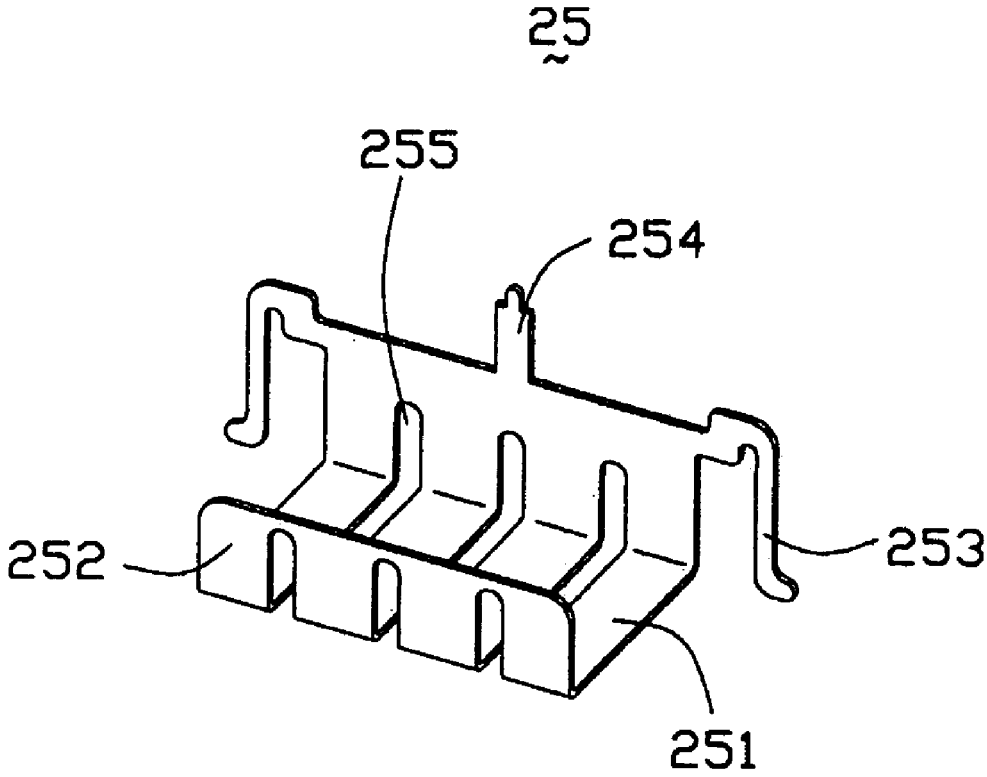
FIG. 9 is a perspective view of a magnetic box liner of the stacked modular jack.

Referring to FIG. 9, the magnetic box liner 25 is stamped from a sheet of metal and includes a horizontal portion 251, a pair of flaps 252 upwardly projecting from opposed sides of the horizontal portion 251. A pair of fingers 253 downwardly extends from one of the flaps 252 and a tab 254 is formed on a middle portion of the flap 252 and positioned in the same plane as the fingers 253. A number of channels 255 are defined in the horizontal portion 251 and the flaps 252 for cooperating with the barriers 218 of the housing 21. A plurality of coils 29 are retained between the barriers 218 for reducing noise, etc.

The internal printed circuit board 28 contains a plurality of signal conditioning components 281, such as capacitors and resistors used for signal conditioning and termination. The internal printed circuit board 28 further defines a plurality of plated through holes 282 therein. Furthermore, two of the first pins 26 for grounding terminals and the second pin array 27 penetrate through corresponding plated through holes 282 and are soldered therein, thereby electrically connecting with the internal printed circuit board above the single molded housing 21.

It is noted that the connecting portions 222 of the contacts 22 and the first pin array 26 (not grounding terminals) are connected by corresponding magnetic coils 29, since the first pin array 26 is electrically connected to a motherboard (not shown), thereby forming an integral electrical connection for transmitting signals received by the contacts 22, the first pin array 26, the magnetic coils 29 and the mother printed circuit board. The second pin array 27 is connected with the corresponding magnetic coils 29. At the same time, the second pin array 27 electrically connects with the internal printed circuit board 28. Therefore, the electrical magnetic interference (EMI) produced in transmission procedure is filtrated through the signal conditioning components 281 on the internal printed circuit board 28 and grounded through the grounding terminals which are electrically connected with the internal printed circuit board 28.

It is can be seen that the tab 254 of the magnetic box liner 25 is inserted into the plated through hole 282 of the internal printed circuit board 28 and electrically connects with the signal conditioning components via the electrical traces of the board 28. The fingers 253 of the liner 25 are fixed in the slots 216 and beyond the main body 21 to electrically connect with the outer metal shell 1, thereby realizing grounding function.

Referring to FIGS. 1–3, the insulative casing 3 includes a horizontal partition 30 divided the casing 3 into a modular plug receiving cavity 31 and an USB plug receiving cavity 32 respectively extending from a front mating face 33. A receiving space 34 is defined in a rear face 35 and communicates with the modular plug receiving cavity 31 and the USB plug receiving cavity 32 through upper channels 36 and a lower opening 37. The insulative casing 3 further defines a pair of grooves 38 extending in a front-to-back direction for receiving the light pipe 22.

The shield 1 includes an upper opening 11 and a lower opening 12 respectively appropriately exposing the modular plug receiving cavity 31 and the USB plug receiving cavity 32 of the insulative casing 3. The upper opening 11 and the lower opening 12 share a parallel bar 131 of a front mating face 13. A plurality of soldertails 14 downwardly extend from a bottom wall (not labeled) of the shield 1 for extending into corresponding holes of the printed circuit board. The light pipe 24 is positioned within upper holes 132 and can be visible from the front mating face 13 of the shield 1.

In assembly, the magnetic subassembly 2 is inserted into the rear of the insulative casing 3 and extends through the modular plug opening 31 in the rear face 35, with the light pipe indicator zones 243 of the light pipe 24 being received in the grooves 38 of the insulative casing 3. The contact module 22 is received in the modular plug receiving cavity 31 of the housing 3. The shield 1 encloses the housing 3 with the light pipe 24 visible from the upper holes 132.

In the present invention, since the magnetic subassembly 2 utilizes a single molded housing 21 to organize the internal printed circuit board 28, the magnetic coils 29, the first and second pin arrays 26, 27, the contact module 22 and the LEDs 23, thereby significantly reducing components and assembly steps. At the same time, the barriers 218 in the single molded housing 21 help to organize the placement of the magnetic coils 29. Consistent placement of coils 29 leads to facilitate reducing electronic magnetic interference (EMI). The magnetic box liner 25 is provided for shielding the magnetic coils 29 from other portions of the inside of the connector 100. In addition, the tab 254 of the liner 25 is inserted into the corresponding hole 282 of the internal printed circuit board 28 and electrically connects with the signal conditioning components via the electrical traces. At the same time, the fingers 253 of the liner 25 project beyond the slots 216 of the single molded housing 21 and contact with the shield 1 for grounding, thereby further decreasing electromagnetic interference. Therefore, the liner 25 also serves as the purpose of connecting the ground on the internal PCB 28.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

a housing;

a molded housing received in the housing and defining a receptacle;

a plurality of contacts received in the housing;

a noise suppressing element received in the receptacle of the molded housing and electrically connected to the contacts; and a metal liner received in the receptacle of the molded housing for shielding the noise suppressing element, wherein the main body of the metal liner wherein the defines a plurality of channels; and wherein the receptacle of the molded housing forms a plurality of barriers for cooperating with corresponding channels of the metal liner.

2. The electrical connector according to claim 1, wherein the metal liner includes a main body and a post upwardly extending from a substantially middle portion of the main body.

3. The electrical connector according to claim 2, further comprising an internal printed circuit board disposed above the molded housing, the internal printed circuit board including a plurality of signal conditioning components, the post of the metal liner electrically connecting with the internal printed circuit board.

4. The electrical connector according to claim 1, wherein the noise suppressing element is received between two adjacent barriers of the molded housing.

5. A modular jack connector adapted for mating with a complementary modular plug, comprising:

a housing;

an electrical subassembly received in the housing and defining a receptacle, the receptacle forming a plurality of barriers;

a plurality of contacts received in the housing and engaging with the complementary modular plug;

a noise suppressing element retained in the electrical subassembly and electrically interconnected with the contacts; and a metal liner shielding the noise suppressing element and having a main body defining a plurality of channels cooperating with the barriers of the receptacle of the subassembly, wherein said subassembly having a main body and a projecting portion forwardly extending from a front portion of the main body; and wherein the contacts are fixed within the projecting portion of the subassembly.

6. The modular jack connector according to claim 5, further including a pair of light emitting diodes each having a tail, and wherein the main body of the molded housing defines a pair of cavities positioned in opposite sides of a rear portion thereof, the tails of the light emitting diodes being inserted into the corresponding cavities.

7. The connector according to claim 5, wherein the connector further includes a printed circuit board attached to the molded housing, and both the contacts and the noise suppressing element mechanically and electrically connected to the printed circuit board.

8. An electrical connector, comprising:

a housing defining a plurality of mating port stacked with one another;

a plurality of contacts received in the housing;

an LED device disposed on a rear portion of the housing with a light portion located essentially at a level of an uppermost mating port; and a light pipe located on a top portion of the housing and extending essentially horizontally along a full dimension of the housing in a front-to-back direction and terminated at a front face of the housing; the electrical connector according further including a molded housing in which a pin array is received, wherein said LED is retained in said molded housing and an internal printed circuit board attached to the molded housing and electrically connected to the contacts, said pin array and noise suppressing element;

wherein a noise suppressing element is contained in said molded housing; and wherein said contacts, said pin army and said noise suppressing element are mechanically connected to the printed circuit board.

9. The electrical connector according to claim 8, wherein the molded housing defines a receptacle in a top face thereof for receiving the noise suppressing element.

* * * * *